US006311354B1

(12) United States Patent
Whittaker et al.

(10) Patent No.: US 6,311,354 B1
(45) Date of Patent: Nov. 6, 2001

(54) PUSH BRUSH CLEANER

(75) Inventors: Richard E. Whittaker; Eric Daytner; Thomas R. Whittaker, all of New Castle, PA (US)

(73) Assignee: R. E. Whittaker Company

( * ) Notice: Subject to any disclaimer, the term of this patent is extended or adjusted under 35 U.S.C. 154(b) by 0 days.

(21) Appl. No.: 08/965,579

(22) Filed: Nov. 6, 1997

(51) Int. Cl.[7] ..... A47L 11/08

(52) U.S. Cl. ..... 15/41.1; 15/49.1; 15/50.3; 15/52.1

(58) Field of Search ..... 15/27, 41.1, 52.1, 15/50.3, 46, 48, 49.1

(56) References Cited

U.S. PATENT DOCUMENTS

| | | | |
|---|---|---|---|
| 541,495 | * | 6/1895 | Paris . |
| 696,443 | * | 4/1902 | Hoppes . |
| 1,537,918 | * | 5/1925 | Cave . |
| 2,737,672 | * | 3/1956 | Weinman . |
| 3,115,656 | | 12/1963 | McKinstry . |
| 3,691,581 | * | 9/1972 | Coult . |
| 3,755,845 | | 9/1973 | Coult . |
| 4,658,458 | * | 4/1987 | Berfield et al. . |
| 4,703,538 | | 11/1987 | Silverstone . |
| 5,427,283 | * | 6/1995 | Whittaker et al. . |
| 5,735,620 | | 4/1998 | Ford . |

FOREIGN PATENT DOCUMENTS

| | | |
|---|---|---|
| 2 249 187 | 4/1974 | (DE) . |
| 0 157 886 | 10/1985 | (EP) . |

* cited by examiner

*Primary Examiner*—Deborah Jones
*Assistant Examiner*—Jennifer McNeil
(74) *Attorney, Agent, or Firm*—Cohen & Grigsby, P.C.

(57) ABSTRACT

The push brush carpet or hard surface cleaner of the present invention is preferably comprised of a cleaning brush with a round surface area to which cleaning bristles of any conventional size and shape are attached. The brush is preferably attached to a frame by use of an axle, wheel and bearing configuration which permits locking of the axle in place at a given rotary position of the brush and also unlocking of the axle to permit rotation of the brush to a different position. In use, the rotary brush is locked in place in a given rotary position by the user, and a portion of the brush surface will come in contact with the carpet or hard surface as the user pushes the brush in a preferably reciprocating motion. In so doing, debris on the carpet or hard surface is agitated and/or expelled by the contacted area of the brush surface. After one area of the brush surface has been exposed to debris, the axle, bearing and wheel configuration permits unlocking, rotation and re-locking of the brush to permit a different portion of the brush surface to contact the carpet or hard surface. In practice the brush is preferably pushed over the carpet or hard surface to agitate and/or expel a debris-laden cleaning solution that has been previously applied to the carpet or hard surface to accomplish cleaning. Finally, the axle, bearing and wheel configuration permits easy disassembly of the brush to allow easy replacement of the brush and to permit accommodation of various brush sizes and bristle varieties.

13 Claims, 1 Drawing Sheet

PUSH BRUSH CLEANER

FIELD OF THE INVENTION

The present invention relates to a device for cleaning carpets or hard surfaces, and in particular relates to a round brush which is preferably pushed over the surface of a carpet or hard surface to agitate and/or expel a debris-laden cleaning solution that has been previously applied to the carpet or hard surface to accomplish chemical cleaning.

BACKGROUND OF THE INVENTION

Many devices exist in the art for cleaning carpets and hard surfaces, and many devices utilize brushes to accomplish the removal of cleaning solutions which have been previously applied to a carpet or hard surface to accomplish chemical cleaning. However, none of the devices in the prior art provides a round brush which may be locked in place as the user manually pushes the brush to remove the chemical cleaning solution, and which may optionally be unlocked to permit the exposure of a different portion of the surface area of the brush to the surface.

The present invention solves this problem by providing a brush with a round surface area that is preferably pushed over the surface of a carpet or hard surface to agitate and/or expel a debris-laden cleaning solution that has been previously applied to accomplish chemical cleaning of the surface and subsurface. The brush is optionally rotatable, and may be locked in place to accomplish the cleaning operation and then unlocked to permit the exposure of a different portion of the surface area of the brush to the surface.

The brush design of the present invention provides many advantages over prior art manually operated push brush designs, such as enabling more consistent cleaning than prior art brush designs due to constant contact of the brush bristles with areas both on and below the exposed surface of the carpet or the hard surface and the ability to periodically shift to an unexposed surface area of the brush, causing less bristle fatigue for a given carpet or hard surface area covered and providing better carpet or floor surface depth penetration for a given amount of user effort due to the rounded design of the brush, and permitting greater ease in changing bristle varieties to accommodate various carpet or hard surface textures, due to the preferred axle and bearing configuration of the brush frame. The present invention also provides many advantages over prior art electromechanical scrubbing devices, such as providing portability and cost economy through elimination of the need for an external source of power.

Accordingly, it is an object of the present invention to provide a cleaning brush with a round surface area that is preferably pushed over the surface of a carpet or hard surface.

It is also an object of the present invention to provide a cleaning brush with a round surface area that is preferably pushed over the surface of a carpet or hard surface to agitate and/or expel a debris-laden cleaning solution that has been previously applied to accomplish chemical cleaning.

It is also an object of the present invention to provide a cleaning brush with a round surface area that is preferably pushed over the surface of a carpet or hard surface which is optionally rotatable, and which may be locked in place to accomplish the cleaning operation and then unlocked to permit the exposure of a different portion of the surface area of the brush.

It is also an object of the present invention to provide a cleaning brush with a round surface area that is preferably pushed over the surface of a carpet or hard surface to enable more consistent cleaning than prior art brush designs due to constant contact of the brush bristles with areas both on and below the exposed surface of the carpet or hard surface and the ability to periodically shift to an unexposed surface area of the brush.

It is also an object of the present invention to provide a cleaning brush with a round surface area that is preferably pushed over the surface of a carpet or hard surface which causes less bristle fatigue than prior art brush designs for a given carpet or floor surface area covered and which provides better carpet or hard surface depth penetration than prior art brush designs for a given amount of user effort.

It is also an object of the present invention to provide a brush with a round surface area that is preferably pushed over the surface of a carpet or hard surface which permits greater ease in changing brush sizes and bristle varieties to accommodate various carpet or hard surface textures due to the preferred axle and bearing configuration of the brush frame.

It is also an object of the present invention to provide a brush with a round surface area that is preferably pushed over the surface of a carpet or over a hard surface which provides portability and cost economy through elimination of the need for an external source of power.

SUMMARY OF THE INVENTION

The push brush carpet and hard surface cleaner of the present invention is preferably comprised of a cleaning brush with a round surface area to which cleaning bristles of any conventional size and shape are attached. The brush is preferably attached to a frame by use of an axle, wheel and bearing configuration which permits locking of the axle in place at a given rotary position of the brush and also unlocking of the axle to permit rotation of the brush to a different position.

In use, the rotary brush is locked in place in a given rotary position by the user, and a portion of the brush surface will come in contact with the carpet or hard surface as the user pushes the brush in a reciprocating manner. In so doing, debris on the surface will be agitated and/or expelled by the contacted area of the brush surface. After one area of the brush surface has been exposed to debris, the axle, bearing and wheel configuration permits unlocking, rotation and re-locking of the brush to permit a different portion of the brush surface to contact the surface. In practice the brush is preferably pushed over the surface of a carpet or a hard surface to agitate and/or expel a debris-laden cleaning solution that has been previously applied to accomplish chemical and/or mechanical cleaning. The cleaning solution can be any conventional chemical solution suitable for the purpose of cleaning, but the brush of the present invention is preferably used for carpet cleaning in conjunction with a dry powder or substantially neutral Ph dry crystalline formula cleaning solution. Finally, the axle, bearing and wheel configuration permits easy disassembly of the brush to allow easy replacement or cleaning of the brush and to permit accommodation of various brush sizes and bristle varieties.

Other details, objects, and advantages of the present invention will become apparent in the following description of the presently preferred embodiments.

BRIEF DESCRIPTION OF THE DETAILED DRAWINGS

DETAILED DESCRIPTION OF THE PRESENTLY PREFERRED EMBODIMENT

Figure 1:
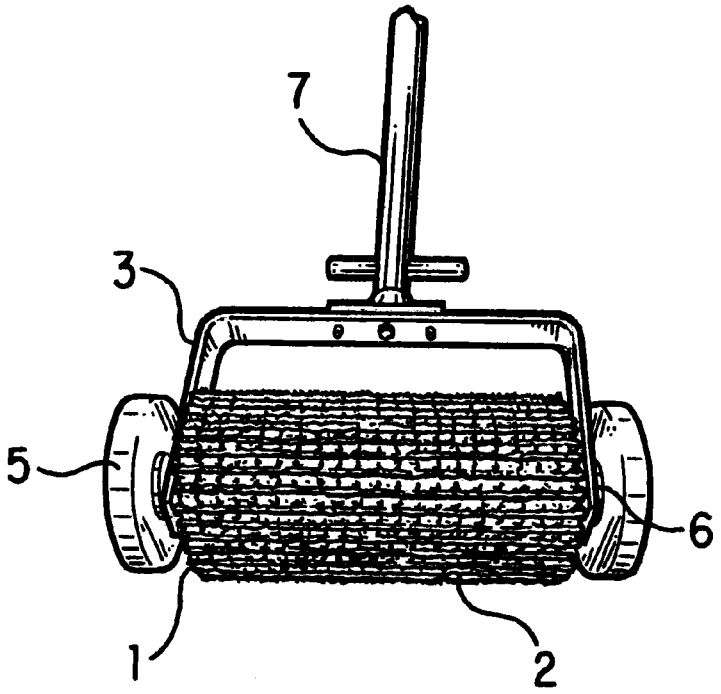
FIG. 1 is an overhead view of the push brush cleaner of the present invention taken in a direction perpendicular to the axis of the brush.
Figure 2:
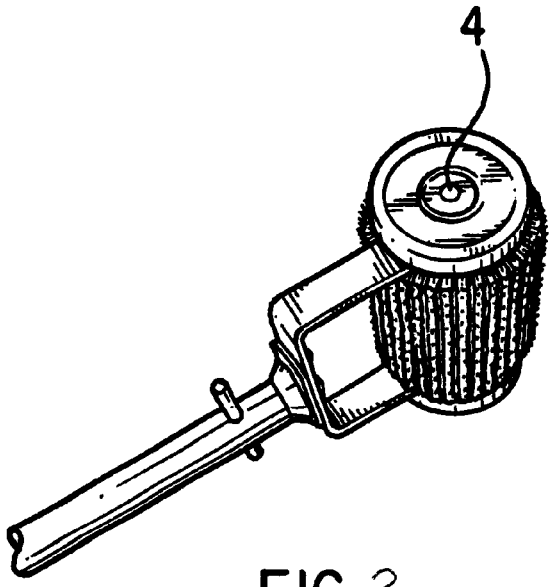
FIG. 2 is an overhead view of the push brush cleaner of the present invention taken in a direction parallel to the axis of the brush.

As shown in FIGS. 1 and 2, the push brush cleaner of the present invention is preferably comprised of a cleaning brush 1 with a round surface area to which cleaning bristles 2 of any desired size and shape are attached. The brush 1 is preferably attached to a frame 3 by use of an axle 4 running axially through the center of the brush, such as a conventional hexagonal axle. Preferably attached to the axle 4 are wheels 5 that each preferably contain a bearing 6 inside which an end of the axle 4 rotates and which permits locking of the axle 4 in place at a given rotary position of the brush 1 along with unlocking of the axle 4 to permit rotation of the brush 1 to a different position. Although the use of wheels 5 is preferred due to the improved cleaning which is caused by the consistent amount of clearance between the brush surface 1 and the cleaned surface created by the wheels 5, the present invention will also accomplish its intended purpose without the use of wheels. Preferably attached to the frame 3 is a handle 7 which is gripped by the user as the brush 1 is pushed over the surface of a carpet or hard surface.

In use, the rotary brush 1 is locked in place in a given rotary position by the user, and a portion of the brush surface 1 will come in contact with the carpet or hard surface as the user pushes the brush across an area of the carpet or surface, preferably in a reciprocating motion which causes the brush 1 to travel in a direction substantially perpendicular to the axle 4. In so doing, debris on and/or below the exposed surface of the carpet or hard floor will be agitated and/or expelled by the contacted area of the brush surface 1 due to the friction created by the coarseness of the bristle pattern 2. After one area of the brush surface 1 has been exposed to debris, through use of conventional well-known locking mechanisms such as for example a ratchet and pawl configuration the axle 4, bearing 6 and wheel 5 configuration permits unlocking and rotation of the brush 1 to permit a different portion of the brush surface 1 to contact the surface, so that the brush 1 may be locked in place in this new rotary position to accomplish the cleaning operation with an unexposed portion of the brush surface 1. In practice the brush 1 is preferably pushed over the surface to agitate and/or expel a debris-laden cleaning solution (not shown) that has been previously applied to the surface to accomplish chemical cleaning. The cleaning solution (not shown) can be any conventional chemical solution suitable for the purpose of cleaning carpets or floors or other hard surfaces, but the brush 1 of the present invention is preferably used for carpet cleaning in conjunction with a dry powder or substantially neutral Ph dry crystalline formula cleaning solution such as the Crystal Dry carpet cleaning agent manufactured by the R. E. Whittaker Company. Finally, the axle 4, bearing 6 and wheel 5 configuration permits easy disassembly of the brush 1 to permit easy replacement of the brush 1 and to allow accommodation of various brush sizes and bristle varieties.

While presently preferred embodiments of practicing the invention have been shown and described with particularity in connection with the accompanying drawings, the invention may otherwise be embodied within the scope of the following claims:

What is claimed is:

1. A device for cleaning a carpet or a hard surface, comprising a brush having a round surface area and a frame attached to said brush that is pushed over a surface of said carpet or hard surface to clean said carpet or hard surface, wherein said brush surrounds an axle that is attached to said frame and to two wheels and each said wheel contains a bearing configured to permit rotation of said brush with said axle independent of said wheels, and wherein said bearing is configured to permit locking of said axle in place at a rotary position of said brush so that said brush does not rotate in either direction when said axle is locked while said brush is pushed over said surface.

2. The cleaning device of claim 1, wherein said bearing is configured to permit rotation of said brush to at least one other rotary position of said brush such that a different position of said brush contacts said carpet or hard surface after said brush is rotated.

3. The cleaning device of claim 2, wherein said brush is removable from said cleaning device.

4. The cleaning device of claim 1, wherein said brush is pushed across an area of said carpet or hard surface in a substantially reciprocating motion.

5. The cleaning device of claim 1, wherein said device agitates a cleaning solution that has been previously applied to said carpet or hard surface to accomplish cleaning of said carpet or hard surface.

6. The cleaning device of claim 5, wherein said cleaning solution is comprised of a chemical mixture suitable for removing debris.

7. The cleaning device of claim 6, wherein said cleaning solution consists of a substantially neutral Ph dry crystalline formula.

8. The cleaning device of claim 6, wherein said cleaning solution consists of a dry powder.

9. The cleaning device of claim 1, wherein said device expels a cleaning solution that has been previously applied to said carpet or hard surface to accomplish cleaning of said carpet or hard surface.

10. The cleaning device of claim 9, wherein said cleaning solution is comprised of a chemical mixture suitable for removing debris.

11. The cleaning device of claim 10, wherein said cleaning solution consists of a substantially neutral Ph dry crystalline formula.

12. The cleaning device of claim 10, wherein said cleaning solution consists of a dry powder.

13. The cleaning device of claim 1, wherein said brush is removable from said cleaning device.

* * * * *